US010763027B2

(12) United States Patent
Wang et al.

(10) Patent No.: US 10,763,027 B2
(45) Date of Patent: Sep. 1, 2020

(54) METHOD TO OPTIMIZE OPERATION OF A TRANSFORMER COOLING SYSTEM, THE CORRESPONDING SYSTEM AND A METHOD TO DETERMINE THE VFD CAPACITY

(71) Applicant: ABB Power Grids Switzerland AG, Baden (CH)

(72) Inventors: Zhao Wang, Beijing (CN); Yao Chen, Beijing (CN); Robert Saers, Vaesteraas (SE); Xiaoxia Yang, Beijing (CN); Rongrong Yu, Beijing (CN)

(73) Assignee: ABB Power Grids Switzerland AG, Baden (CH)

( * ) Notice: Subject to any disclaimer, the term of this patent is extended or adjusted under 35 U.S.C. 154(b) by 408 days.

(21) Appl. No.: 15/092,238

(22) Filed: Apr. 6, 2016

(65) Prior Publication Data

US 2016/0293314 A1 Oct. 6, 2016

Related U.S. Application Data

(63) Continuation of application No. PCT/CN2013/085667, filed on Oct. 22, 2013.

(51) Int. Cl.
*H01F 27/20* (2006.01)
*H01F 27/12* (2006.01)
(Continued)

(52) U.S. Cl.
CPC ..... *H01F 27/20* (2013.01); *H01F 27/085* (2013.01); *H01F 27/12* (2013.01); *H01F 27/42* (2013.01); *H01H 9/0005* (2013.01)

(58) Field of Classification Search
CPC ..... H01F 27/12; H01F 27/20; H01F 27/42; H01F 27/085; H01H 9/0005
See application file for complete search history.

(56) References Cited

U.S. PATENT DOCUMENTS 6,886,985 B1 * 5/2005 Kostrzewsky ..... F16C 37/002 384/317
6,909,349 B1 * 6/2005 Longardner ..... F25B 15/00 336/60
(Continued)

FOREIGN PATENT DOCUMENTS

CN 201256048 Y 6/2009
CN 201902353 U 7/2011
(Continued)

OTHER PUBLICATIONS

Statistics How to: Weighting Factor, Statistical Weight and Weight Functions: Definition, Uses; www.statisticshowto.datasciencecentral.com, printed out Feb. 6, 2019.*
(Continued)

*Primary Examiner* — M. N. Von Buhr
(74) *Attorney, Agent, or Firm* — Sage Patent Group

(57) ABSTRACT

The present application discloses a method to optimize operation of a transformer cooling system, the corresponding cooling system, and a method to determine the capacity of Variable Frequency Drives (VFD) that are used in the transformer cooling system. The method comprises: preprocessing the initial data input by user; collecting the on-line data, and calculating the optimized control command to meet the requirement of the transformer loss, top-oil temperature variation and noise; and executing the control actions by controlling a controllable switch and/or sending a control command to a VFD. Compared with the existing prior arts, the proposed solutions are much more intuitive and practical in the field of the cooling system.

20 Claims, 7 Drawing Sheets

(51) Int. Cl.

| | |
|---|---|
| ***H01H 9/00*** | (2006.01) |
| ***H01F 27/42*** | (2006.01) |
| ***H01F 27/08*** | (2006.01) |

(56) References Cited

U.S. PATENT DOCUMENTS

| | | | | |
|---|---|---|---|---|
| 7,962,250 | B2 * | 6/2011 | Bretzner | G05D 23/19 62/157 |
| 8,416,042 | B2 * | 4/2013 | Schwaiger | H01F 27/085 336/60 |
| 8,976,526 | B2 * | 3/2015 | Kulkarni | H02M 7/003 307/10.6 |
| 9,153,374 | B2 * | 10/2015 | Kulkarni | H05K 7/1432 |
| 9,363,930 | B2 * | 6/2016 | Kulkarni | H05K 7/20936 |
| 9,419,430 | B1 * | 8/2016 | Tostrud | G06Q 10/0635 |
| 2004/0023614 | A1 * | 2/2004 | Koplin | G06F 1/18 454/184 |
| 2005/0180846 | A1 * | 8/2005 | Hopkins | F04D 25/166 415/119 |
| 2007/0240648 | A1 * | 10/2007 | Badami | F01K 13/02 122/504 |
| 2008/0004940 | A1 * | 1/2008 | Rolleston Phillips | G06Q 10/04 705/7.28 |
| 2008/0294297 | A1 * | 11/2008 | Bretzner | G05D 23/19 700/300 |
| 2010/0010859 | A1 * | 1/2010 | Ratakonda | G06Q 10/06 705/7.13 |
| 2011/0014061 | A1 * | 1/2011 | Hopkins | F04D 25/166 417/3 |
| 2011/0031322 | A1 * | 2/2011 | Zou | F24F 3/0442 236/1 B |
| 2011/0074317 | A1 * | 3/2011 | Gibson | F04D 25/166 318/68 |
| 2011/0221554 | A1 * | 9/2011 | Schwaiger | H01F 27/085 336/60 |
| 2011/0224832 | A1 * | 9/2011 | Nishiguchi | G05B 17/02 700/276 |
| 2012/0065804 | A1 * | 3/2012 | Biswal | H02J 3/48 700/297 |
| 2012/0187764 | A1 * | 7/2012 | Rockenfeller | H02J 9/062 307/66 |
| 2013/0024014 | A1 * | 1/2013 | Sharma | G05B 17/02 700/29 |
| 2013/0030783 | A1 * | 1/2013 | Nishiguchi | G05B 13/0265 703/13 |
| 2013/0167560 | A1 * | 7/2013 | Wong | G05B 15/02 62/56 |
| 2013/0334998 | A1 * | 12/2013 | Osman | H02P 1/028 318/503 |
| 2014/0039689 | A1 * | 2/2014 | Honda | G05B 15/02 700/276 |
| 2014/0244051 | A1 * | 8/2014 | Rollins | B01F 3/04078 700/282 |
| 2014/0252864 | A1 * | 9/2014 | Kulkarni | H05K 7/20936 307/82 |
| 2015/0253027 | A1 * | 9/2015 | Lu | G05B 15/02 700/276 |
| 2018/0058463 | A1 * | 3/2018 | Rollins | F04D 25/0606 |

FOREIGN PATENT DOCUMENTS

| | | | |
|---|---|---|---|
| CN | 102200137 | A | 9/2011 |
| CN | 103324130 | A | 9/2013 |
| JP | 58225617 | A | 12/1983 |
| JP | S5933809 | A | 2/1984 |
| JP | 59126611 | A | 7/1984 |
| JP | S6057603 | A | 4/1985 |

OTHER PUBLICATIONS

International Search Report, PCT/CN2013/085667, ABB Technology Ltd. et al., dated Jul. 29. 2014.

Written Opinion, PCT/CN2013/085667, ABB Technology Ltd. et al., dated Jul. 29, 2014.

Indian Examination Report, Indian Patent Application No. 201647008154, dated Oct. 31, 2018, 8 pages.

Chinese Office Action, Chinese Patent Application No. 201380080387.X, dated Jan. 11, 2017, 18 pages including machine translation in English.

Chinese Search Report, Chinese Patent Application No. 201380080387.X, dated Jan. 11, 2017, 4 pages including machine translation in English.

Extended European Search Report, European Patent Application No. 13895881.4, dated May 11, 2017, 7 pages.

Brazilian Patent Office, Office Action issued in corresponding Brazilian application No. BR112016006060-1, dated Jan. 21, 2020, 5 pp.

* cited by examiner

METHOD TO OPTIMIZE OPERATION OF A TRANSFORMER COOLING SYSTEM, THE CORRESPONDING SYSTEM AND A METHOD TO DETERMINE THE VFD CAPACITY

FIELD OF THE INVENTION

This invention relates to the cooling technical field, and more particularly to a method to optimize operation of a transformer cooling system, the corresponding transformer cooling system, and a method to determine the capacity of Variable Frequency Drives (VFD) that are used in the said transformer cooling system.

BACKGROUND OF THE INVENTION

Transformer is one of the most critical components of a substation, whose safety, reliability and efficiency are of high importance to the overall power grid. For each transformer, especially power transformers with voltage level 110 kV and above, a dedicated cooling system consisting of multiple motor-fan units is required to keep the winding temperature within an acceptable range. The operation of the transformer is therefore closely related to 1) how the cooling system is designed and 2) how the cooling system is operated.

As to the cooling system design, it is common understanding that variable speed operation of these cooling fans can achieve higher efficiency compared with fixed speed operation. Therefore transformer cooling systems tend to install VFDs for motor-fan units to ensure high efficiency operation, the system architectures are shown in FIG. 1A and FIG. 1B. However, these two types of architecture have their own disadvantages. The first architecture as shown in FIG. 1A requires high capital investment because it installs VFD for each motor-fan chain; plus if the motor-fan chain is mostly working at rated speed, VFD solution might lower the efficiency due to its own power losses. The second architecture as shown in FIG. 1B can relatively reduce the capital investment because it uses one big VFD to drive a plurality of motor-fan chains jointly at the same operation point. But the disadvantages are also obvious: Firstly, each motor-fan chain has low efficiency when the VFD utilized capacity is relatively low; secondly, there are different ways for load distribution among different VFD-fed motor-fan chains to meet the same total output requirement. It is not always true to distribute the load evenly among individual chains in order to have optimal system efficiency.

As to cooling system operation, the core is how to control the winding temperature. Normally, lower winding temperature leads to the lower copper loss of winding. However, the power consumption of the cooling system will be higher at the same time, meaning that the overall efficiency, considering both transformer winding and the cooling system itself, might be less optimal.

Besides efficiency, the variation of the winding temperature is also one key factor which will affect the lifecycle of the transformer. The more frequency the temperature varies, the faster the transformer aging will be. It could be so that the efficiency of the transformer is optimized, however at a cost of shortened transformer lifetime.

For transformer operated at urban area, noise level is also one important criterion to consider in order to reduce the impact on the neighbouring residents especially at night. Currently, few solution is available to control the cooling system to tackle the noise problem.

To overcome above shortcomings, the person skilled in the art aims to solve two problems as follows.

1) How to design the cooling system to realize speed regulation for the motor-fan loads selectively with less capital investment on VFDs.

2) How to improve the operation efficiency of transformer by cooling control considering the transformer copper loss, the motor-fans power consumption and the speed regulation of VFD.

3) How to control the winding temperature as well as its variation in order to extend the lifecycle of the transformer and meanwhile achieve the best overall system efficiency.

4) How to operate the cooling system to optimize not only the efficiency and lifecycle, but also minimize the noise level so as to reduce the negative impact on the surrounding environment.

SUMMARY OF THE INVENTION

The objects of the present invention are achieved by a method to optimize operation of a transformer cooling system, the corresponding cooling system, and a method to determine capacity of the VFDs that are used in the said transformer cooling system, in order to improve the operation efficiency of the whole transformer with limited capital investment on cooling system hardware upgrade, and meanwhile to extend the transformer lifecycle and lower the noise level of the transformer system.

According to one aspect of the invention, said method to optimize the operation of the transformer cooling system, comprises the following steps: preprocessing the initial data input by user; collecting the on-line data, and calculating the cooling capacity required to meet the requirements of transformer loss; and executing the control actions by controlling a controllable switch and/or sending a control command to a VFD.

According to a preferred embodiment of the present invention, said calculating the optimized control command step further considers the requirement of the top-oil temperature variation and/or the noise level.

According to a preferred embodiment of the present invention, said calculating the optimized control command step further considers the requirements according to the weighting factors of the transformer loss, the top-oil temperature variation and the noise level, which are capable of pre-defining by the user.

According to a preferred embodiment of the present invention, said preprocessing step comprises the following steps: collecting parameters of the transformer type, the transformer ratio, and the ratio of load losses at rated current to no-load losses; collecting parameters of the transformer thermal model; collecting parameters of the tap changer mid position, the step voltage and the present tap changer position; collecting parameters of the cooler type, the fan number and the power of the radiator; and collecting the relationship curve between the fan noise and the fan capacity.

According to a preferred embodiment of the present invention, said preprocessing step further includes the following steps: calculating the transformer copper loss; calculating the winding temperature; calculating the load current of different sides; and calculating the power consumption of cooling system.

According to a preferred embodiment of the present invention, said on-line data includes: the load current, the temperatures and the status of the cooler; and said calculating step comprises the following steps: calculating the cooling capacity required to meet said requirement; calculating the number of fans including the fan driven by the VFD; comparing the fans required with the existing fans in operation; and leading to different possible operation solutions in accordance with the comparison.

According to a preferred embodiment of the present invention, the actual transformer loss $P_K'$ under specific load level for three-winding transformer is calculated by the following equation:

$$P_k' = \frac{1+\alpha\overline{\theta_w}}{1+75\alpha}(\beta_1^2 P_{k1N} + \beta_2^2 P_{k2N} + \beta_3^2 P_{k3N})$$

Wherein, $\overline{\theta_w}$ is the average winding temperature; $\alpha$ is temperature factor; $\beta_1$, $\beta_2$, $\beta_3$ are load factors; $P_{k1N}$, $P_{k2N}$, $P_{k3N}$ are the winding losses at rated current.

According to a preferred embodiment of the present invention, said top-oil temperature variation $D\theta_0$ over time dt is calculated by the following equation:

$$D\theta_o = \left\{\left[\frac{1+RK^2}{1+R}\right]^x \cdot \Delta\theta_{or} \cdot \frac{100}{X_{cor}} - (\theta_{oi} - \theta_a)\right\} \cdot \frac{dt}{\tau_o}$$

Wherein, $\Delta\theta_{or}$ is top-oil temperature rise in the steady state at rated losses (K); R is ratio of load losses at rated current to no-load losses; K is load factor; $\tau_o$ is average oil time constant; $\theta_{oi}$ is the top-oil temperature at prior time; $\theta_a$ is the ambient temperature; $X_{cor}$ is the rate of cooling in operation.

According to a preferred embodiment of the present invention, the total noise from the transformer and the fan $Lp_t$ is calculated by the following equation:

$$Lp_t = \begin{cases} Lp_{N1}, & Lp_{fan} = 0 \\ Lp_{N1} + 101\ \mathrm{g}\left[1 + 10^{\frac{Lp_{N1} - Lp_{fan}}{10}}\right], & Lp_{N1} > Lp_{fan} \\ Lp_{fan} + 101\ \mathrm{g}\left[1 + 10^{\frac{Lp_{fan} - Lp_{N1}}{10}}\right], & Lp_{fan} > Lp_{N1} \end{cases}$$

Wherein, $Lp_{fan}$ is the fan noise; $Lp_{N1}$ is the transformer noise.

According to a preferred embodiment of the present invention, said different possible operation solutions comprises: switching on the integer fans with lower utilization rate and driving the rest fans by VFD with calculated frequency; switching off the integer number of fans with higher utilization rate and driving the rest fans by the VFD with calculated frequency; or changing the fan driven by the VFD with calculated frequency.

According to a preferred embodiment of the present invention, said control actions includes: the start or stop of the fans; controllable switch operation; or VFD frequency regulation.

According to another aspect of the invention, said method to determine capacity of the VFDs used in the said transformer cooling system, comprises the following steps: inputting parameters and the objectives of the transformer loss, the top-oil temperature variation and the noise; calculating the Net Present Value (NPV) curve versus of the VFD capacity which shows the relationship between the saved energy loss and the VFD cost; calculating the VFD capacity limit for the pre-defined top-oil temperature variation; calculating the VFD capacity limit for the pre-defined noise level; determining the VFD capacity which has highest NPV, meanwhile within the limits to fulfil both top-oil temperature variation and noise level requirements.

According to a preferred embodiment of the present invention, said highest NPV is determined with the following steps: calculating saved energy loss of the cooling system due to the VFD; calculating the capital cost of the VFD; evaluating the NPV of the VFD considering both benefit and cost; and selecting the VFD capacity with the highest NPV.

According to another aspect of the invention, said transformer cooling system, comprises a central controller, a transformer and a plurality of fans to cool down said transformer. Said transformer cooling system further comprises a shared VFD bus fed by VFD and an AC bus fed by AC power source, both of which being controlled by said central controller. Said shared VFD bus is shared by two or more motor-fan chains and selectively driving one, two or more said motor-fan chains.

According to a preferred embodiment of the present invention, each of said motor-fan chain connects to a controllable switch, which switches said motor-fan chain among connecting to said AC bus, connecting to said shared VFD bus, and disconnecting from power supplies.

Compared with the existing prior arts, the solution of the present invention saves the capital investment to upgrade cooling system hardware for transformer cooling system operation optimization. Another benefit of the present invention is that it can optimize the real-time operation efficiency of transformer by coordinating the transformer copper loss, cooling system power consumption, and VFD settings for individual motor-fan chain, meanwhile realize transformer lifecycle extension and noise level limitation.

BRIEF DESCRIPTION OF THE DRAWINGS

The subject matter of the invention will be explained in more details in the following description with reference to preferred exemplary embodiments which are illustrated in the drawings, in which:

FIGS. 1A and 1B show an electrification scheme of the conventional transformer cooling system; in which FIG. 1A illustrates the structure of respectively installing VFD for each motor-fan chain, and FIG. 1B illustrates the structure of a plurality of motor-fan chains jointly driven by one VFD;

DETAILED DESCRIPTION OF PREFERRED EMBODIMENTS

Exemplary embodiments of the present invention are described in conjunction with the accompanying drawings hereinafter. For the sake of clarity and conciseness, not all the features of actual implementations are described in the specification.

Figure 1A:
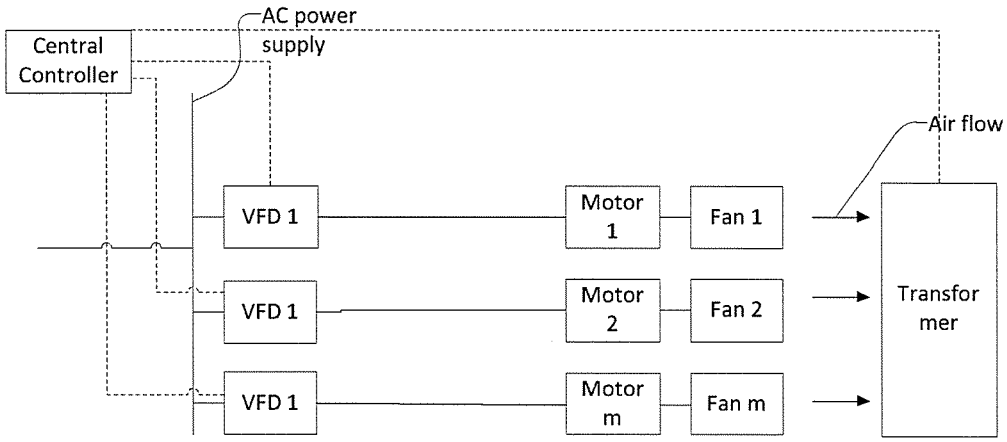
Fig. 1A Prior Art
Figure 1B:
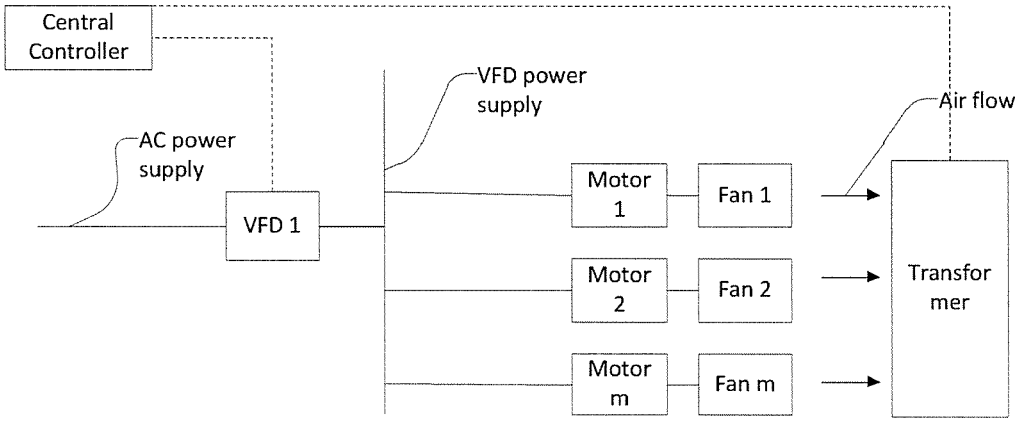
Fig. 1B Prior Art
Figure 2:
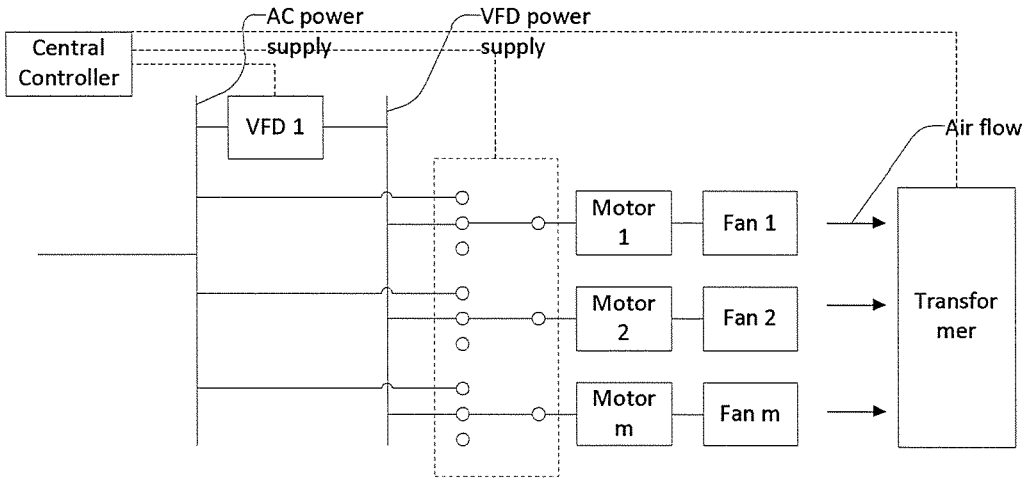
FIG. 2 shows an electrification scheme of the transformer cooling system according to an embodiment of the present invention.

According to the first preferred embodiment, the electrical system design of the transformer cooling system is shown in FIG. 2, which consists of two power supply schemes for motor-fan loads, including an AC line supply and a VFD supply (e.g. VFD1 in FIG. 2).

As shown in FIG. 2, one or more motor-fan chains can be connected to the VFD bus, the AC bus or disconnected from power supplies respectively through the controllable switches. That means, the motor-fan chains can only have one out of three statuses at one time: connecting to AC line, connecting to VFD, or disconnecting from power supplies.

By coordinating the VFD and controllable switches, the start-up process of motor-fan loads can be optimized. As shown in FIG. 2, a motor-fan load can be switched to VFD for soft start. After completing the start-up process, it can be switched back to the AC line if it is operated at the rated output. In order to optimize the operation, the status information of VFD and controllable switches are all transmitted to a central controller. Besides these, the central controller also gets access to the real-time transformer load data, oil temperature and ambient temperature. With all these data, the controller performs the efficiency optimization calculation, top oil and its variation calculation, and noise level calculation of the whole transformer. After that, it will send out the control command to controllable devices, e.g. controllable switches for gross temperature regulation, and VFD for fine temperature regulation.

Figure 3:
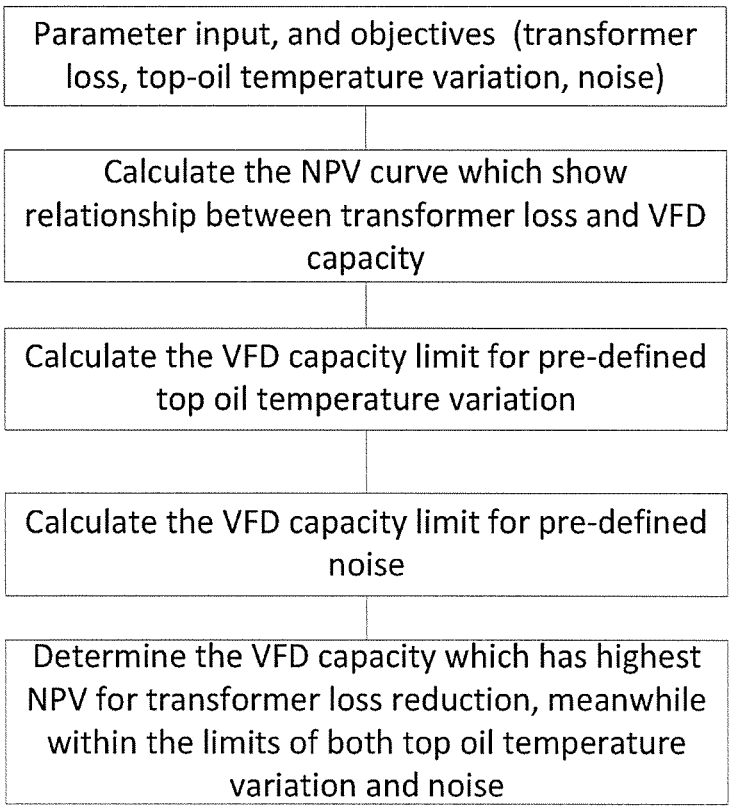
FIG. 3 is the overall flow-chart for VFD capacity determination according to an embodiment of the present invention.

According to the second preferred embodiment, the size of the VFD can be determined by techno-economic analysis to ensure best cost-effectiveness of the given type of transformer. The higher the VFD capacity is, the more accurate the temperature control will be, which can contribute to overall operation performance improvement. However, the cost of the VFD will also increase which will affect the business case. Meanwhile, different type of transformers have different cooling capacity requirement. The sizing of VFD should also take this into account. FIG. 3 shows the overall procedures for VFD capacity determination. Firstly, the parameters and the operation objectives, e.g. transformer loss, top-oil temperature variation and expected noise level will be input by the users; secondly, the NPV curve which shows the relationship between transformer loss and VFD capacity will be calculated; thirdly, the VFD capacity limitations to achieve the predetermined top-oil temperature variation and noise level requirements will be calculated; fourthly, the VFD capacity can be determined which has the highest NPV for transformer loss reduction, and meanwhile can fulfill the lifecycle and noise level requirement.

Figure 4:
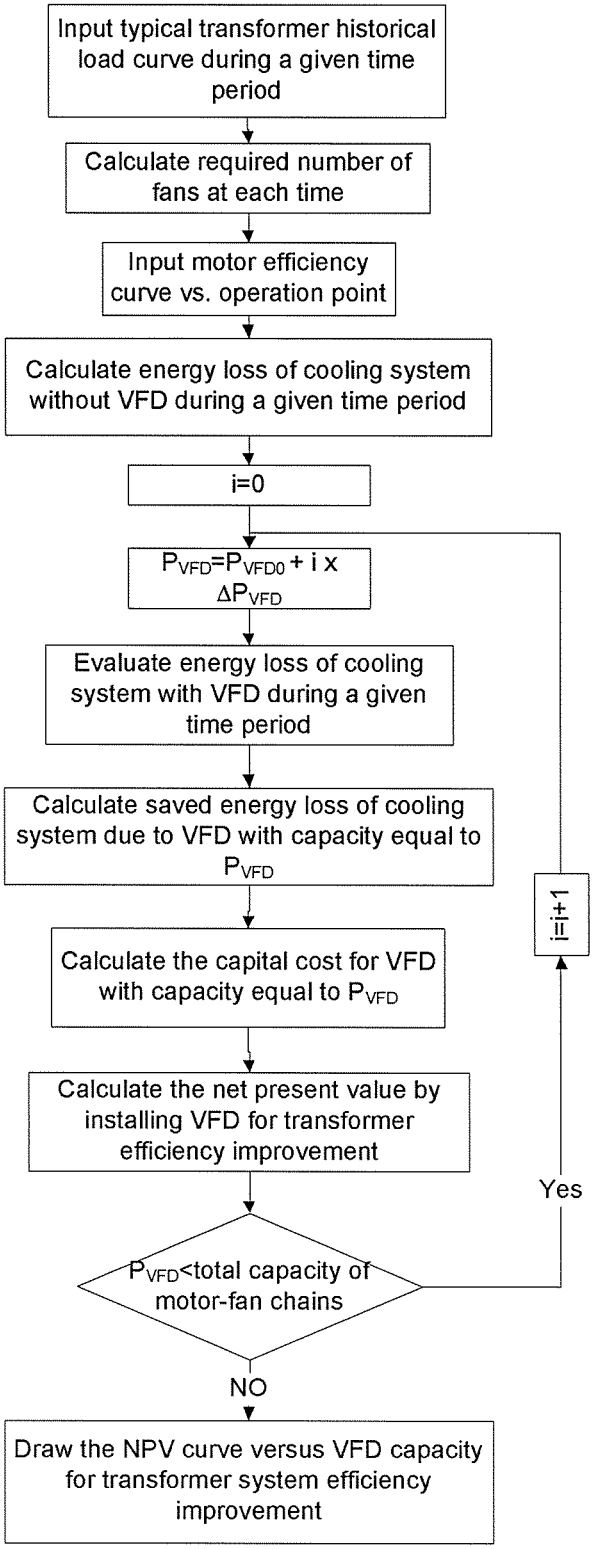
FIG. 4 is the flow-chart for net present value calculation due to transformer efficiency improvement by installing different capacity of VFD in the cooling system according to an embodiment of the present invention.

FIG. 4 illustrates how to calculate the NPV curve versus VFD capacity through transformer system efficiency improvement. In FIG. 4, $P_{VFD}$ represents the rated capacity of the VFD; $P_{VFD0}$ and $\Delta P_{VFD}$ represent the initial capacity and incremental capacity of VFD used for iteration By calculating the save energy loss through VFD, and the corresponding capital investment of VFD, the net present value curve can be obtained versus different VFD capacities.

Figure 5:
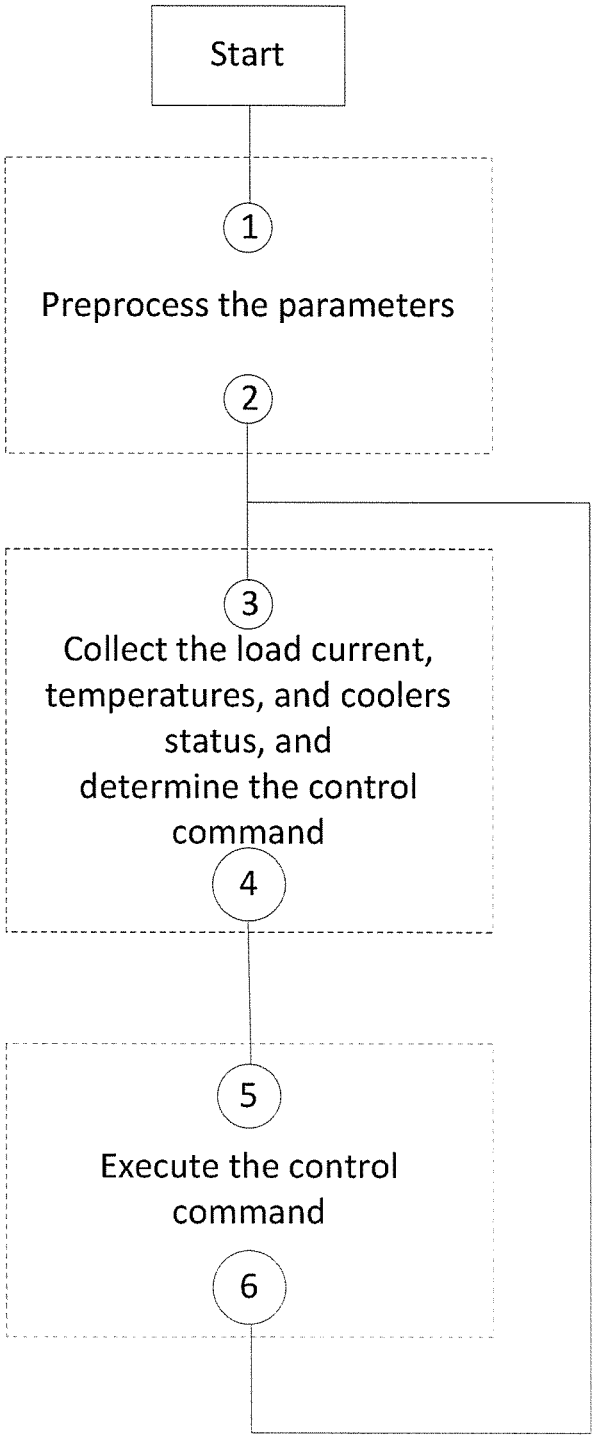
FIG. 5 is the main flow-chart for operation optimization of transformer cooling system according to an embodiment of the present invention.

According to another preferred embodiment, the central controller performs the optimization calculation in real-time. The flowchart is shown in FIG. 5. Whenever the optimization result changes, the central controller will update the control commands for VFD and/or controllable switches respectively.

Figure 6:
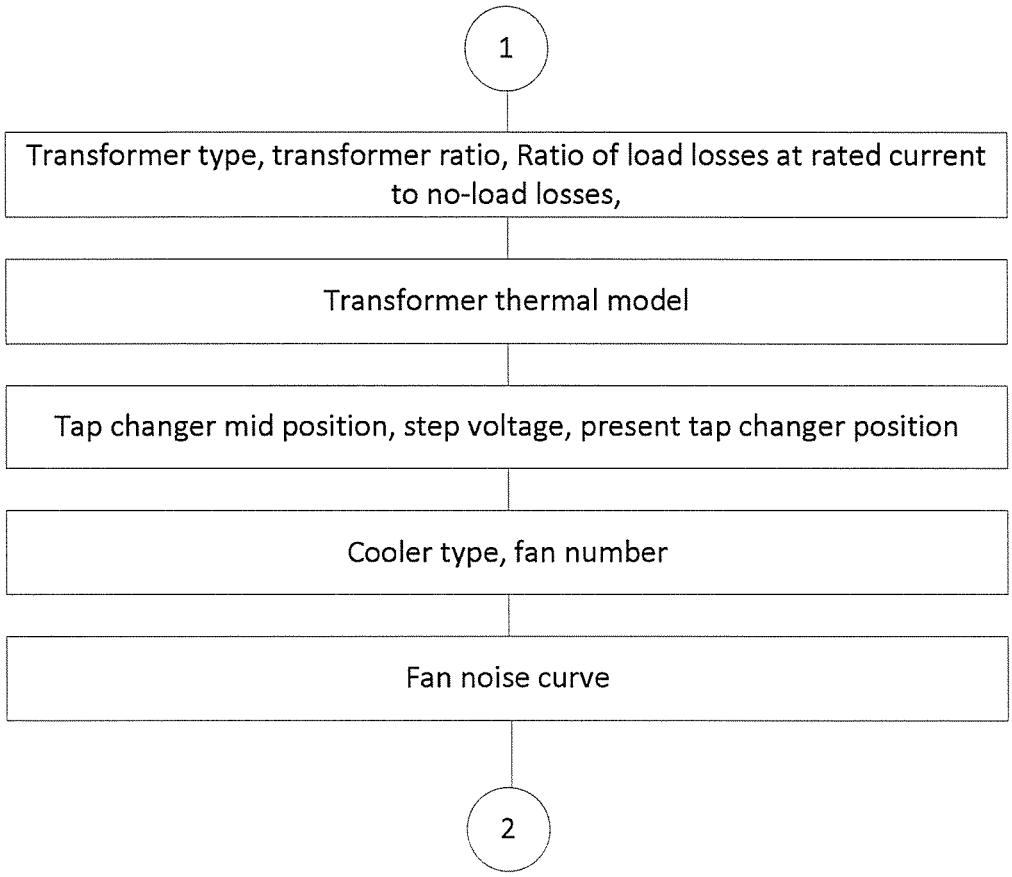
FIG. 6 illustrates a flow chart of parameters preprocessing procedures according to an embodiment of the present invention.

Step 1: the first step of the flowchart is to preprocess the initial data input by user. The detailed information is shown in FIG. 6, where totally five groups of data will be collected as follows:

1) The transformer type, ratio, and ratio of load losses at rated current to no-load losses. The method uses them to calculate the copper loss.
2) Winding exponent, oil exponent, hot-spot to top-oil gradient, hot-spot factor, ambient temperature, average oil time constant, winding time constant, hot-spot-to-top-oil gradient at start, hot-spot-to-top-oil gradient at the rated current, top-oil temperature rise in steady state at rated losses, top-oil temperature rise at start, the load permissible in % of nameplate rating when all fans inoperative. The method uses them to calculate the hot-spot temperature which can be regarded as the winding temperature.
3) Tap changer mid position, step voltage, present tap changer position. The method uses them to calculate the load current of different sides.
4) Cooler type, fan number, the power of radiator. The method uses them to calculate the power consumption of cooling system.
5) Relationship curve between fan noise and fan capacity.

After the preprocessing, all information except real-time data will be ready for calculation.

Step 2: the second step, the central controller collects the load current, temperatures and the status of cooler. And then calculate the cooling capacity which can meet the requirements of transformer loss, top-oil temperature variation and/or transformer noise requirements. The detailed procedures for calculating winding loss, oil-temperature variation and noise are described from Section A to Section C; and the method to combine this three dimensional control objectives together using weighting factors are described in Section D.

Figure 7:
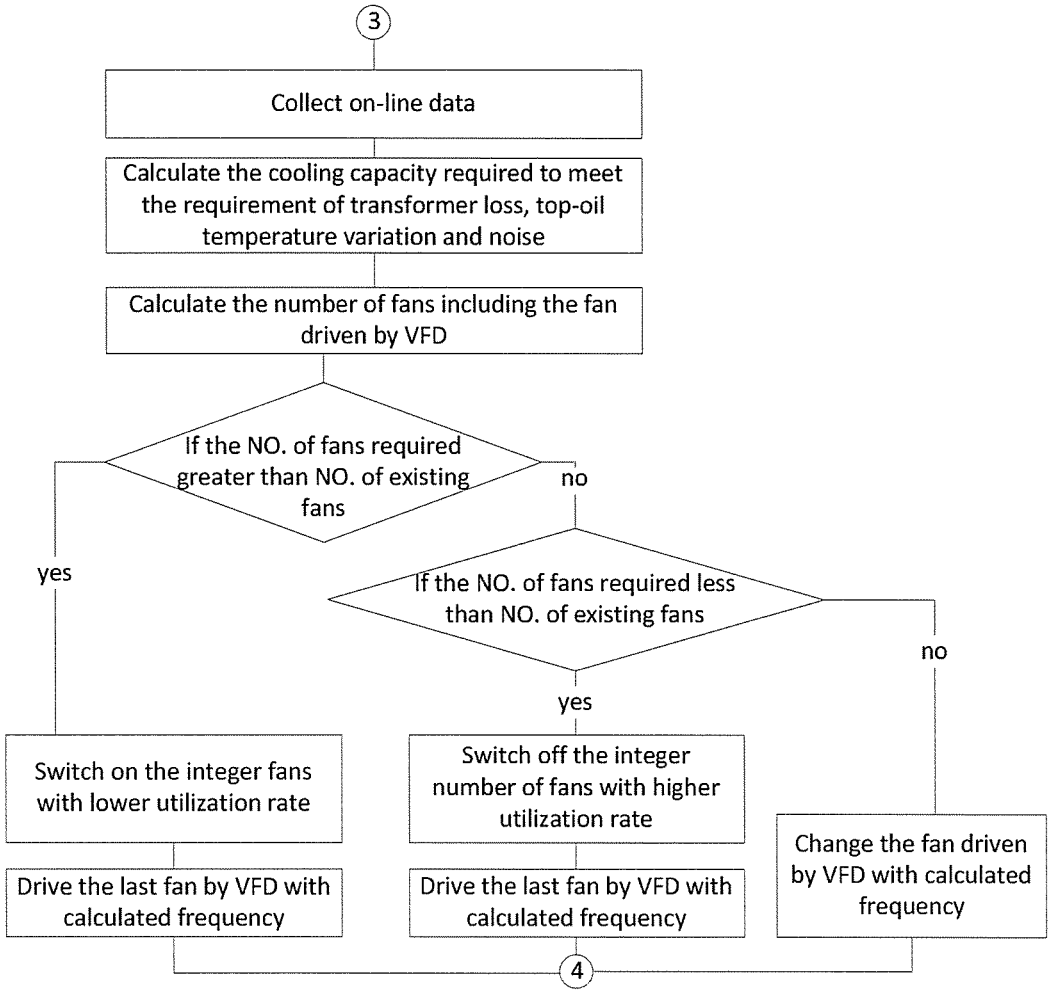
FIG. 7 illustrates a flow chart of control command determination according to an embodiment of the present invention.

After the optimal cooling capacity is obtained by the central controller, the control strategy will lead to three possible operation solutions as shown in FIG. 7: if the number of fans required is greater, less than or equal to the number of existing fans in operation.

If the number of fans required is nf_next, the number of existing fans is nf_prior, then $n_{f\Delta}=\mathrm{fix}(n_{f_next})-\mathrm{fiX}(n_{f_prior})$;

$n_{VFD}=n_{f_next}-(n_{f_prior}+n_{f\Delta})$;

If $n_{f\Delta}>0$, switch on the corresponding number of fans; otherwise, switch off the corresponding number of fans. And the rest fans driven by VFD should change $N_{VFD}$.

When to increase or decrease percentage of transformer cooling, the central controller calculates the number of motor-fan chains needed, it is assumed that the number of motor-fan chains in operation is $m_1 \cdot n_1$, the number calculated is $m_2 \cdot n_2$, where $m_i$ is the integer number and $n_i$ is the percentage of cooling capacity which will achieved by VFD. The central controller gets the integer number of motor-fan chains by $m_2-m_1$. The speed regulation of VFD can be calculated by $n_2$. The priority of motor-fan chains depend on the utilization time. The central controller prioritizes the motor-fan chains according to the utilization time. Then, the central controller selects to start the motor-fan chain with lower utilization time, and selects to stop the motor-fan chain with higher utilization time.

A. Basic Mathematics for Transformer Loss Calculation

For three-winding transformer, the actual winding loss under specific load level is $$P'_k = \frac{1+\alpha\overline{\theta_w}}{1+75\alpha}(\beta_1^2 P_{k1N} + \beta_2^2 P_{k2N} + \beta_3^2 P_{k3N}) \quad (1)$$

Where, $\overline{\theta_w}$: the average winding temperature;

$\alpha$: temperature factor;

$\beta_1$, $\beta_2$, $\beta_3$: load factor;

$P_{k1N}$, $P_{k2N}$, $P_{k3N}$: the winding loss at rated current;

Assume $n_f$ equals to the total required cooling power divided by rated cooling power of each motor-fan chain $P_f$, which consists of two parts: $n_r$, which is the integer part, and $n_v$, which is the decimal part.

Assume $n_r$ is contributed by fans operated at rated speed; and $n_v$ is contributed by fans controlled by VFD operated at partial speed. The total power demand can be expressed as (2), where $\eta$ is the efficiency of the VFD.

$$P_{fans}=n_r\times P_f+n_v\times P_f/\eta \quad (2)$$

If all fans are at the same speed and all driven by VFDs, we have $$P_{fans}=n_f\times P_f/n \quad (3)$$

The transformer loss can be calculated as formula (4)

$$f_1=P_t=P_k'+P_{fans}+C \quad (4)$$

Where, C is constant the power consumption of other parts.

B. Basic Mathematics for Transformer Top-Oil Temperature Calculation

The top-oil temperature variation over time dt is calculated by equation (5), $$D\theta_o = \left\{\left[\frac{1+RK^2}{1+R}\right]^x \cdot \Delta\theta_{or} \cdot \frac{100}{X_{cor}} - (\theta_{oi}-\theta_a)\right\} \cdot \frac{dt}{\tau_o} \quad (5)$$

Then the difference between the top-oil temperature and a given value is f2, $$f_2=\mathrm{abs}(\theta_{oi}+D\theta_o-\theta_{om}) \quad (6)$$

Where, $\Delta\theta_{or}$: top-oil temperature rise in the steady state at rated losses (K);

R: ratio of load losses at rated current to no-load losses;

K: load factor;

$\tau_o$: average oil time constant;

$\theta_{oi}$: the top-oil temperature at prior time;

$\theta_a$: the ambient temperature;

$\theta_{om}$: the given value of top oil temperature;

$X_{cor}$: the rate of cooling in operation, which can be calculated by equation (7), where N is the rated current ratio of ONAN condition to ONAF condition;

$$X_{cor} = \left(N + \frac{X}{100}(1-N)\right)\times 100 \quad (7)$$

C. Basic Mathematics for Transformer Noise Level Calculation

The transformer noise is $Lp_{N1}$ at ON condition, and $Lp_{N2}$ when all the fans are in operation at rated speed. The relationship between the noise $Lp_{fan}$ caused by fans and the proportion of fans X is shown in equation (8):

$$Lp_{fan}=f(X) \quad (8)$$

So when the proportion of fans in operation is X, the total noise from the transformer and the fan is:

$$f_3 = Lp_t = \begin{cases} Lp_{N1}, & Lp_{fan}=0 \\ Lp_{N1} + 101\ \mathrm{g}\left[1+10^{\frac{Lp_{N1}-Lp_{fan}}{10}}\right], & Lp_{N1} > Lp_{fan} \\ Lp_{fan} + 101\ \mathrm{g}\left[1+10^{\frac{Lp_{fan}-Lp_{N1}}{10}}\right], & Lp_{fan} > Lp_{N1} \end{cases} \quad (9)$$

Wherein, $Lp_{fan}$: the fan noise;

$Lp_{N1}$: the transformer noise.

D. Objective Function with Weighting Factors

When the cooling capacity varies, the variation of the loss $f_1$, the top oil temperature $f_2$ and the noise $f_3$ are obviously different. In order to unify them, the maximum and minimum values of these three objectives $f_{1min}$, $f_{1max}$, $f_{2min}$, $f_{2max}$, $f_{3min}$ and $f_{3max}$ are calculated at each moment and put into the objective function shown in (10).

By using weighting factors $w_1$, $w_2$, $w_3$ for these three objectives, the objective function can be expressed as:

$$f_{obj} = w_1\frac{f_1}{f_{1max}-f_{1min}} + w_2\frac{f_2}{f_{2max}-f_{2min}} + w_3\frac{f_3}{f_{3max}-f_{3min}} \quad (10)$$

where, $w_1+w_2+w_3=1$

With formula (10), the optimal cooling capacity for all three objectives can be calculated. Also, each of objectives can be met individually when set its weight to 1, and set other weights to 0.

Figure 8:
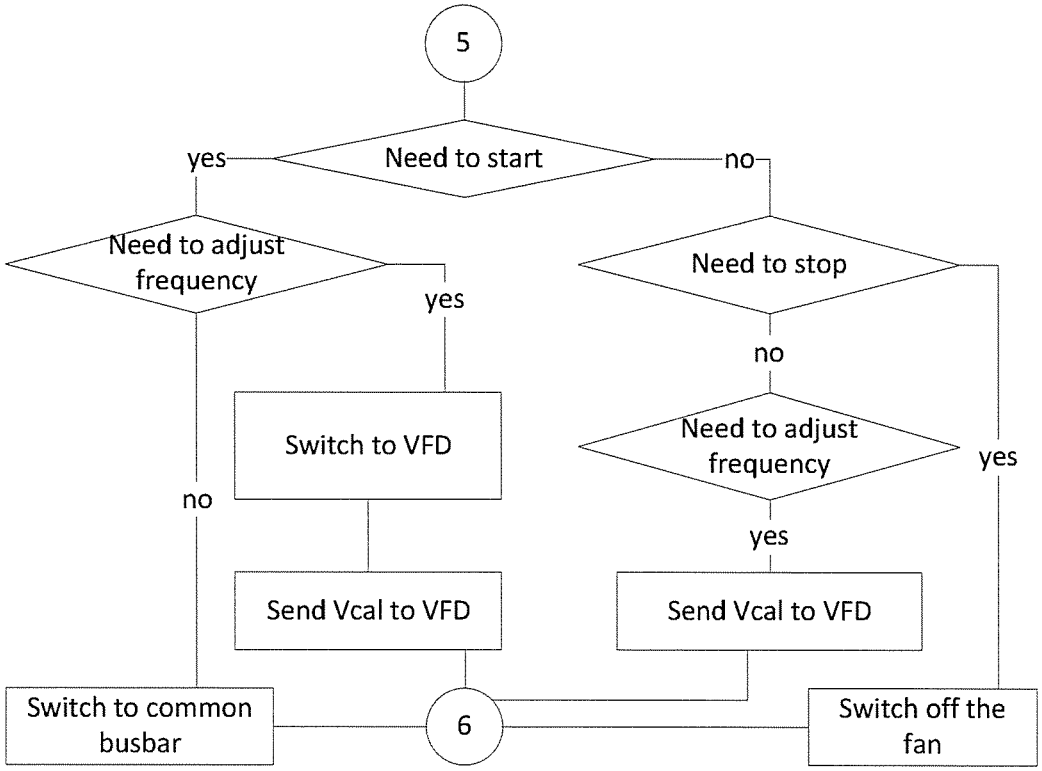
FIG. 8 illustrates a flow chart of control command execution according to an embodiment of the present invention.

Step 3: the third step, after the control commands calculation, the central controller will execute the results by controlling the switches directly or sending the control command to VFD, as shown in FIG. 8, where the control actions includes the start and stop of fans, controllable switch operation, and VFD frequency regulation.

To start the fan, the central controller switches the motor-fan which does not need VFD directly to AC lines. For the motor-fan chain will be driven by VFD, the control center switches it to VFD, and sends the speed regulation reference to VFD.

To stop the fan, the central controller directly switches the motor-fan chains off-line.

The central controller repeats the Step 2 and Step 3 in real-time.

Advantages of the Method and System According to this Invention:

This invention proposes a novel transformer cooling system and the corresponding operation method for optimal temperature control, which can improve the operation efficiency of the whole transformer with very limited capital investment on cooling system hardware upgrade, and meanwhile to extend the transformer lifecycle and lower the noise level of the transformer system.

In this invention, the motor-fan loads of the cooling system will be controlled by one VFD selectively according to the temperature control requirement. For motor-fan loads needs to operate at rated power, they will connect to the AC bus directly. The temperature control will consider efficiency of the transformer windings and the cooling system together. Meanwhile, transformer top-oil temperature variation will be controlled in an coordinated way to extend the lifecycle. Furthermore, transformer noise level will be considered together in the cooling control in order to minimize the impact on the surrounding environment. With the proposed electrical design and the control method, the cooling system can be operated in an optimal way to achieve cost-effective efficiency improvement of the whole transformer.

Though the present invention has been described on the basis of some preferred embodiments, those skilled in the art should appreciate that those embodiments should by no means limit the scope of the present invention. Without departing from the spirit and concept of the present invention, any variations and modifications to the embodiments should be within the apprehension of those with ordinary knowledge and skills in the art, and therefore fall in the scope of the present invention which is defined by the accompanied claims.

The invention claimed is:

1. A method to improve operation of a transformer cooling system, wherein the transformer cooling system comprises a central controller, a transformer, a plurality of motor-fan chains to cool down said transformer, a shared variable frequency drive (VFD) bus fed by a VFD, and an alternating current (AC) bus fed by an AC power source, both of the VFD bus and the AC bus being controlled by said central controller, and both of the VFD bus and the AC bus being shared by motor-fan chains, the method comprising:

preprocessing an initial data input by a user;

collecting an on-line data corresponding to a transformer loss associated with driving at least one motor-fan chain of the plurality of motor fan chains with at least one of the VFD bus or the AC bus;

calculating a control command of the transformer cooling system to meet a requirement of a transformer loss by computing a control objective based on initial data and the on-line data, wherein the control command includes an instruction to selectively drive, based at least in part on the transformer loss, at least one motor-fan chain of the plurality of motor fan chains with at least one of the VFD bus or the AC bus; and executing control actions associated with the control command by selectively driving, based at least in part on the transformer loss, the at least one motor-fan chain with at least one of the VFD bus or the AC bus.

2. The method according to claim 1, wherein said calculating the control command is further based on at least one of a top-oil temperature variation of the transformer and a noise level of the transformer and a fan.

3. The method according to claim 2, wherein said calculating the control command is further based on a weighting factor of at least one of the transformer loss, the top-oil temperature variation, and the noise level.

4. The method according to claim 3, wherein said preprocessing further includes:

collecting parameters of a transformer type, a transformer ratio, and a ratio of load losses at rated current to no-load losses;

collecting parameters of a transformer thermal model;

collecting parameters of a tap changer mid position, a step voltage and a present tap changer position;

collecting parameters of a cooler type, a fan number and a power of a radiator; and collecting a relationship curve between a fan noise and a fan capacity.

5. The method according to claim 2 further comprising:

calculating the top-oil temperature variation over time by the following equation:

$$D\theta_o = \left\{\left[\frac{1+RK^2}{1+R}\right]^x \cdot \Delta\theta_{or} \cdot \frac{100}{X_{cor}} - (\theta_{oi} - \theta_a)\right\} \cdot \frac{dt}{\tau_o}$$

wherein:

$D\theta_0$ is the top-oil temperature variation;

dt is the time;

$\Delta\theta_{or}$ is a top-oil temperature rise in a steady state at rated losses (K);

R is a ratio of load losses at rated current to no-load losses;

K is a load factor;

$\tau_o$ is an average oil time constant;

$\theta_{oi}$ is a top-oil temperature at prior time;

$\theta_a$ is an ambient temperature; and $X_{cor}$ is a rate of cooling in operation.

6. The method according to claim 2, further comprising:

calculating the noise level of the transformer and the fan by the following equation:

$$Lp_t = \begin{cases} Lp_{N1}, & Lp_{fan} = 0 \\ Lp_{N1} + 101\ \mathrm{g}\left[1 + 10^{-\frac{Lp_{N1} - Lp_{fan}}{10}}\right], & Lp_{N1} > Lp_{fan} \\ Lp_{fan} + 101\ \mathrm{g}\left[1 + 10^{-\frac{Lp_{fan} - Lp_{N1}}{10}}\right], & Lp_{fan} > Lp_{N1} \end{cases}$$

wherein:

$Lp_t$ is a total noise level of the transformer and the fan;

$Lp_{fan}$ is a fan noise; and $Lp_{N1}$ is a transformer noise.

7. The method according to claim 2, wherein said preprocessing further includes:

collecting parameters of a transformer type, a transformer ratio, and a ratio of load losses at rated current to no-load losses;

collecting parameters of a transformer thermal model;

collecting parameters of a tap changer mid position, a step voltage and a present tap changer position;

collecting parameters of a cooler type, a fan number and a power of a radiator; and collecting a relationship curve between a fan noise and a fan capacity.

8. The method according to claim 2, wherein said on-line data further includes: a load current, a temperatures and a status of a cooler; and wherein calculating the control command further includes:

calculating a cooling capacity required to meet said requirement;

calculating a number of the motor-fan chains required to meet said cooling capacity;

comparing the number of motor-fan chains required with an existing number of motor-fan chains in operation; and changing an operation solution in accordance with the comparison.

9. The method according to claim 1, wherein said preprocessing further includes:

collecting parameters of a transformer type, a transformer ratio, and a ratio of load losses at rated current to no-load losses;

collecting parameters of a transformer thermal model;

collecting parameters of a tap changer mid position, a step voltage and a present tap changer position;

collecting parameters of a cooler type, a fan number and a power of a radiator; and collecting a relationship curve between a fan noise and a fan capacity.

10. The method according to claim 9, wherein said preprocessing further includes:

calculating a transformer copper loss;

calculating a winding temperature;

calculating a load current of different sides of a transformer; and calculating a power consumption of cooling system.

11. The method according to claim 1 wherein said on-line data further includes: a load current, temperatures and status of a cooler; and wherein said calculating further includes:

calculating a cooling capacity required to meet said requirement;

calculating a number of the motor-fan chains required to meet said cooling capacity;

comparing the number of motor-fan chains required with an existing number of motor-fan chains in operation; and changing an operation solution in accordance with the comparison.

12. The method according to claim 11, wherein said changing the operation solution further includes:

switching on the number of the motor-fan chains with utilization rate lower than a current utilization rate and driving a remainder of the motor-fan chains by the VFD with a calculated frequency; and switching off the number of the motor-fan chains with utilization rate higher than a current utilization rate and driving a remainder of the motor-fan chains by the VFD with a calculated frequency.

13. The method according to claim 11, wherein said changing the operation solution further includes:

switching on the number of the motor-fan chains with utilization rate lower than a current utilization rate and driving a remainder of the motor-fan chains by the VFD with a calculated frequency; and changing the motor-fan chains driven by the VFD with the calculated frequency.

14. The method according to claim 1 further comprising:

calculating the transformer loss under a load level for three-winding transformer by the following equation:

$$P_k' = \frac{1+\alpha\overline{\theta_w}}{1+75\alpha}(\beta_1^2 P_{k1N} + \beta_2^2 P_{k2N} + \beta_3^2 P_{k3N})$$

wherein:

$P_K'$ is the transformer loss;

$\overline{\theta_w}$ is an average winding temperature;

$\alpha$ is a temperature factor;

$\beta_1$, $\beta_2$, $\beta_3$ are load factors; and $P_{k1N}$, $P_{k2N}$, $P_{k3N}$ are winding losses at rated current.

15. The method according to claim 1 wherein said control actions further include:

at least one of a start or stop of at least one of the motor-fan chains associated with the transformer cooling system; and a controllable switch operation associated with the transformer cooling system.

16. The method according to claim 1, wherein the initial data further includes:

parameters and objectives of the transformer loss, a top-oil temperature variation of the transformer and a noise of the transformer, and wherein calculating the control command further includes:

calculating a Net Present Value (NPV) curve versus a VFD capacity which shows a relationship between a saved energy of the transformer cooling system which can be attributed to the VFD and a VFD cost;

calculating a VFD capacity limit for a pre-defined top-oil temperature variation;

calculating a VFD capacity limit for a pre-defined noise; and determining a VFD capacity which has the highest NPV, and which is within limits of both top-oil temperature variation and noise.

17. The method according to claim 16, wherein determining the VFD capacity which has the highest NPV further includes:

calculating the saved energy of the transformer cooling system which can be attributed to the VFD;

calculating a capital cost of the VFD;

evaluating a net present value (NPV) of the VFD considering both benefit and cost; and selecting the VFD capacity with the highest NPV.

18. The method according to claim 1, wherein each of said motor-fan chains is connected to a controllable switch configured to switch said motor-fan chains among connecting to said AC bus, connecting to said VFD bus, and disconnecting from power supplies.

19. The method according to claim 1, wherein said control actions further include:

at least one of a start or a stop of at least one of the motor-fan chains; and a VFD frequency regulation.

20. A transformer cooling system comprising:

a transformer;

a shared variable frequency drive (VFD) bus configured to be fed by a VFD; and an alternating current (AC) bus configured to be fed by an AC power source, a plurality of motor-fan chains;

a controllable switch switchable among a plurality of connection states, the plurality of connection states comprising:

an AC connection state wherein at least one motor-fan chain of the plurality of motor-fan chains is connected to the AC bus;

a VFD connection state wherein at least one motor-fan chain of the plurality of motor-fan chains is connected to the VFD bus; and a disconnected state wherein the plurality of motor-fan chains are disconnected from the AC bus and the VFD bus; and a central controller configured to:

determine a transformer loss of the transformer; and generate control commands to cause the controllable switch to selectively switch among the plurality of connection states based on the transformer loss.

* * * * *